US007559352B2

(12) United States Patent
Rodriguez

(10) Patent No.: US 7,559,352 B2
(45) **Date of Patent: *Jul. 14, 2009**

(54) HEALING ENHANCEMENT APPARATUS FORMED FROM MULTI-PANEL CURTAIN WITH A CALMING IMAGE

(76) Inventor: Ernesto Rodriguez, 122 Hill St., Avalon, CA (US) 90704

( * ) Notice: Subject to any disclaimer, the term of this patent is extended or adjusted under 35 U.S.C. 154(b) by 222 days.

This patent is subject to a terminal disclaimer.

(21) Appl. No.: 11/258,276

(22) Filed: Oct. 24, 2005

(65) Prior Publication Data

US 2006/0037722 A1 Feb. 23, 2006

Related U.S. Application Data

(63) Continuation-in-part of application No. 10/345,113, filed on Jan. 15, 2003, now Pat. No. 6,957,684.

(60) Provisional application No. 60/348,947, filed on Jan. 15, 2002.

(51) Int. Cl.
*A47H 1/00* (2006.01)

(52) U.S. Cl. ..... 160/330; 160/10; 101/42; 358/450; 382/284

(58) Field of Classification Search ..... 160/10, 160/330; 101/41, 42, 485; 358/450, 1.18; 382/284; 112/439, 401, 470.1; 28/163; 2/243.1
See application file for complete search history.

(56) References Cited

U.S. PATENT DOCUMENTS 5,107,780 A * 4/1992 Braun ..... 112/314
5,574,829 A * 11/1996 Wallace et al. ..... 358/1.1
5,681,259 A * 10/1997 August ..... 600/27
6,254,527 B1 * 7/2001 August ..... 600/27
6,503,188 B1 * 1/2003 August ..... 600/27
6,631,683 B2 * 10/2003 Krinsky ..... 101/483
6,641,522 B2 * 11/2003 August ..... 600/27
6,903,656 B1 6/2005 Lee
6,957,684 B2 * 10/2005 Rodriguez ..... 160/330
2004/0145454 A1 7/2004 Powell et al.
2004/0164858 A1 8/2004 Lin
2005/0040974 A1 2/2005 Shanks et al.
2005/0088299 A1 4/2005 Bandy et al.
2005/0093679 A1 5/2005 Zai et al.
2005/0113138 A1 5/2005 Mendolia et al.

* cited by examiner

*Primary Examiner*—Blair M. Johnson
(74) *Attorney, Agent, or Firm*—Myers Andras Sherman LLP; Joseph C. Andras

(57) ABSTRACT

Disclosed is a healing enhancement apparatus formed from a curtain bearing a calming image such as an outdoor scene or other image of nature. The healing enhancement apparatus, an alternative to the sterile environment found in most hospitals, has therapeutic benefits. In particular, the calming image, occupying all or most of the curtain assists in calming the patient, reducing blood pressure, reducing required medications, and assists in quicker recoveries. The calming image may be applied to first and second panels of cloth that are stitched together, in registration, at a seam. The calming image may extend from edge-to-edge, or may occupy a framed portion of the curtain. The calming image may consists of an outdoor scene as viewed through one or more windows and, where the image contains two or more windows, the seam may be conveniently located within the image of the wall surface between adjacent windows.

11 Claims, 8 Drawing Sheets

A = HEIGHT, 76"
B = WIDTH, 104"
C =MURAL HEIGHT, 48"
D=MURAL WIDTH (2-PANELS)
E=MURAL WIDTH (1-PANEL)
F=TOP BORDER
G=SIDE BORDER
H=BOTTOM BORDER, 21"
I=SEAM ALLOWANCE, 1/2"
J=MAXIMUM PANEL WIDTH, 52"

IMAGE PORTIONS IN REGISTRATION

HEALING ENHANCEMENT APPARATUS FORMED FROM MULTI-PANEL CURTAIN WITH A CALMING IMAGE

This application is a continuation in part of U.S. patent application Ser. No. 10/345,113, filed on Jan. 15, 2003, now U.S. Pat No. 6,957,684, which application claims the benefit or provisional patent application No. 60/348,947 filed on Jan. 15, 2002.

FIELD OF THE INVENTION

The present invention relates generally to a healing enhancement apparatus formed from multi-panel hospital bed cubicle curtain with a calming image.

BACKGROUND OF THE RELATED ART

Medical research supports the use of calming images to reduce stress and to create a healing environment. See for example, the 1995 study conducted by Clare Cooper Marcus, Mass., MCP and Marni Barnes, MLA, LCSW at University of California at Berkeley, entitled "GARDENS IN HEALTH-CARE FACILITIES: USES, THERAPEUTIC BENEFITS, AND DESIGN RECOMMENDATIONS". The Marcus/Barnes study was published by The Center for Health Design. Another example is the research that reported in an 1999 article in the American Medical Association entitled "The Arts of Healing" by M. J. Friedrich. Dr. Friedrich observes that "Postsurgery patients in Sweden who looked consistently at a painting of calm water and trees made a more rapid recovery than those whose view showed abstract rectilinear forms . . ." The foregoing articles are hereby incorporated by reference in their entirety.

Generally speaking, the research tends to show that calming images such as nature images reduce-a patient's anxiety level, blood pressure, and required medication so that the patient tends to recover sooner. Simply put, calming scenes enhance healing and to promote well-being for patients, staff and visitors. For this reason, or perhaps purely for subjective aesthetics, one may find framed nature pictures in a hospital environment. Generally speaking, however, hospitals and their patient recovery rooms tend to have a sterile "beige" look and feel that is not consistent with the research mentioned above.

In a typical hospital environment, some rooms are private, one patient rooms, but many rooms are designed to contain two or more patient beds. In either case, so-called hospital bed cubicle curtains are frequently used as privacy screens while medical procedures are performed or while patients are resting or visiting with family. The cubicle curtain, therefore, is one of the largest, most prominent items in the room and the patient is quite literally forced to view it for days on end. The conventional cubicle curtain, however, is usually provided in standard hospital monotones (e.g. beige) such that they tend to continually remind the patient of their ongoing health concerns.

There remains a need, therefore, for a healing enhancement apparatus in the form of a curtain that carries a calming image that brings the healing benefits of calming images to an enhanced level.

SUMMARY OF THE INVENTION

In a first aspect, the invention resides in a healing enhancement apparatus comprising a curtain and a calming image printed on the curtain.

In a more particular aspect, the invention resides in a healing enhancement apparatus comprising a curtain; and a calming image on the curtain, the curtain further comprising: a first substantially rectangular panel of cloth having a first portion of the calming image; and a second substantially rectangular panel of cloth having a second portion of the calming image; wherein the first and second panels and corresponding portions of the calming image are joined to one another at a seam.

In another more particular aspect, the invention resides in a healing enhancement apparatus comprising: a hospital bed cubicle curtain; and a calming image on the hospital bed cubicle curtain, the hospital bed cubicle curtain further comprising: a first substantially rectangular panel having a first portion of the calming image; and a second substantially rectangular panel having a second portion of the calming image; the first and second panels and corresponding portions of the calming image joined to one another at a seam, the calming image covering substantially all of the hospital bed cubicle curtain.

BRIEF DESCRIPTION OF THE DRAWINGS

The just summarized invention can be best understood with reference to the following description taken in view of the drawings of which.

DETAILED DESCRIPTION OF THE PREFERRED EMBODIMENTS

Figure 1:
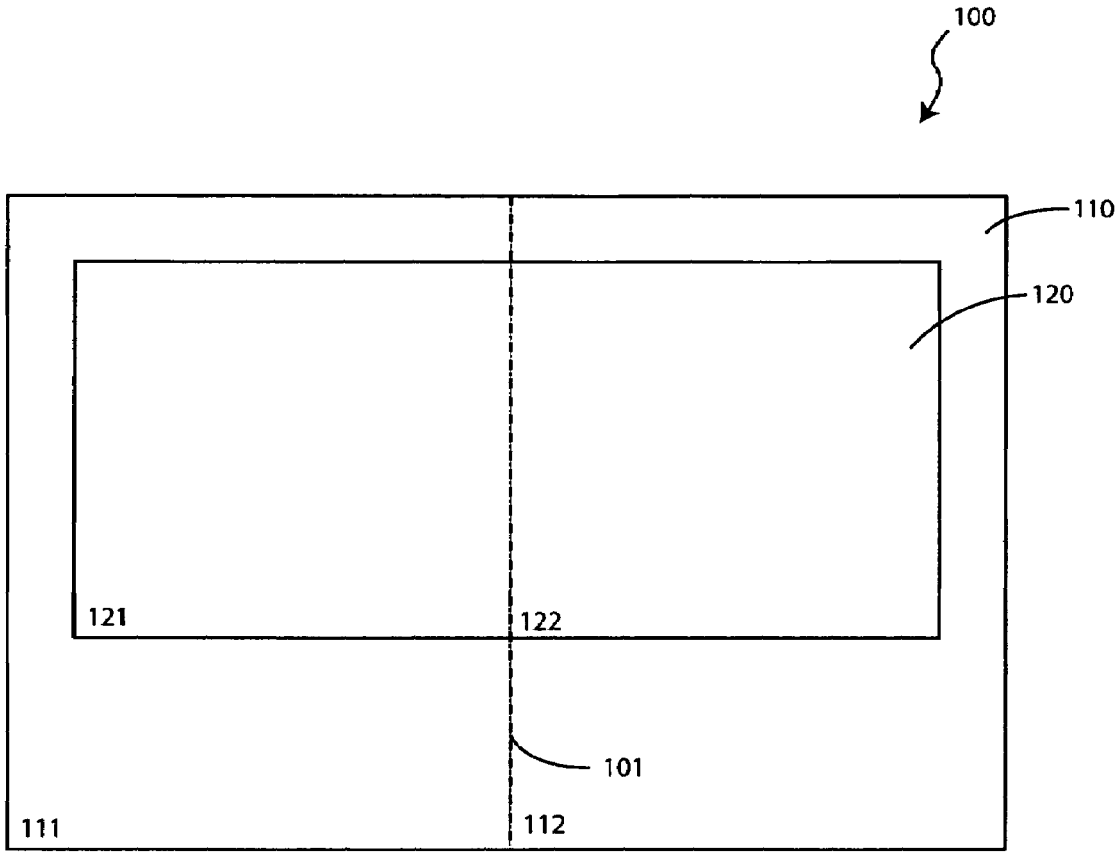
FIG. 1 is a simplified side view of an improved cubicle curtain 100 according to a first embodiment of this invention where a calming image 120 is surrounded by a frame area 110.

The herein described cubicle curtains are formed from an image printed fabric. They are aptly being marketed under the trademark of SERENEVIEW. They have garnered a great deal of interest from the hospital industry due to their healing affect.

The process of printing an image on fabric to be fabricated into a cubicle curtain begins with selecting a continuous tone image. A continuous tone image can be a photograph (e.g. a Polaroid, a negative, a transparency, or a digital file) or a painting or other artwork that is done with traditional media such as watercolor, pastels, oils or acrylics. In our preferred process, we use photography to produce continuous tone images, and Polaroid SX70 film is the only film choice for continuous tone. Traditional small-format film when reproduced at our finished size would begin to show the film grain, which would not be visually pleasing. As explained below, however, the desired image may also be captured as a large format transparency as well, the sheer size of the format providing sufficient resolution for recreation at the large scale needed here.

Once an image is selected, if it is not already digital, it is then scanned or otherwise digitized to the finished product size. The file is color and contrast corrected to produce a digital prototype that is examined for color, composition, and design flaws at full size. Once changes are made, the corrected digital file is prepared for sublimation four-color process printing. This is the only printing process that will accurately render a piece of artwork on cloth. Suitable technologies that are presently known to the inventor, as discussed more fully below, include customized digital four-color ink jet techniques and four color separation lithography techniques. It should be understood, however, that there are many possible ways of transferring a calming image to cloth. Thus, other suitable techniques may also be used including, but not limited to, rotary screen printing and direct-to-cloth printing.

At present, the sublimation process is limited to printing on panels that are a maximum of 77×52 inches. Therefore, to produce a calming image, or mural, you must print the image across several, initially separate panels, and then join the panels together until the desired image size is achieved.

To achieve color consistency across the panels that compose a mural, you must use the same batch of inks to print all of the panels. They further need to be printed under the same temperature and humidity conditions. A specific temperature/time transfer sequence of panels then becomes necessary to uniformly sublimate the inks onto the fabric.

Once the panels are printed they are assembled into a finished product. Because the panels are sewn together to achieve the finished product, a seam allowance had to be created so the panels flow visually across each other.

The cubicle curtains described herein are a combination of photography and digital painting. They are printed by way of dye sublimation on fire-retardant and non fire-retardant fabrics for use in commercial, healthcare, hospitality and residential markets. The finished printed images are joined together to produce a complete image unlimited in vertical and horizontal dimension as a result of joining multiple images together. After the images are joined together, the fabric is manufactured into finished, hospital cubicle curtains.

FIRST EMBODIMENT

FIG. 1 is a simplified side view of an improved cubicle curtain 100 according to a first embodiment of this invention where a calming image 120 is surrounded by a frame area 110.

Figure 2:
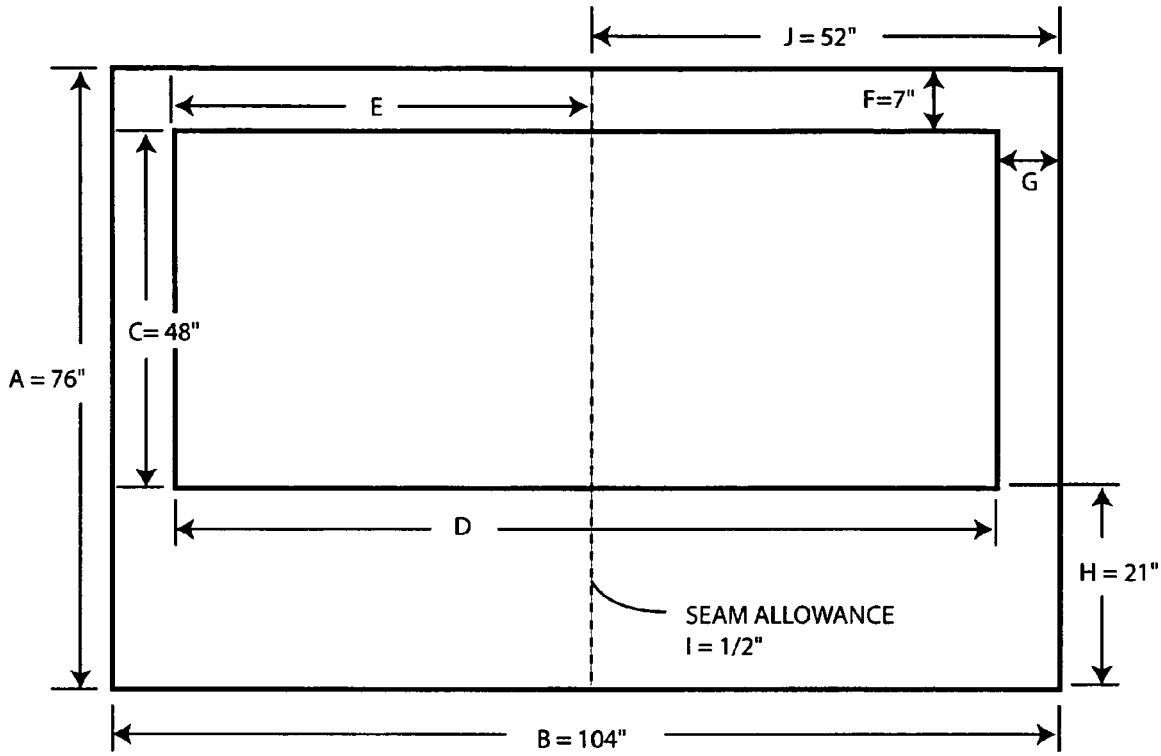
FIG. 2 is a simplified side view of the improved cubicle curtain 100 of FIG. 1 with exemplary dimensions noted.
Figure 3:
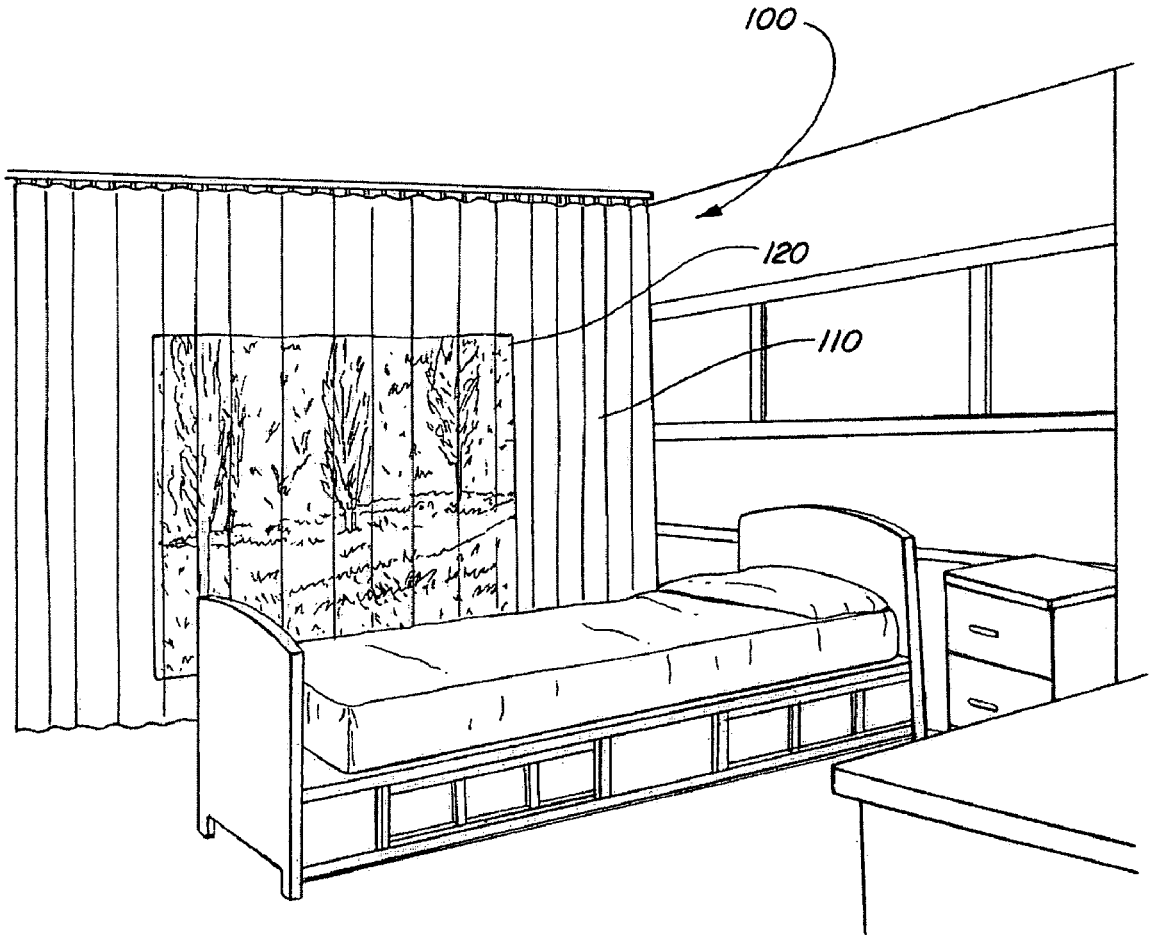
FIG. 3 is a perspective view of the improved cubicle curtain 100 of FIG. 1 as deployed from an overhead track in a typical hospital room.

FIG. 2 is a simplified side view of the improved cubicle curtain 100 of FIG. 1 with exemplary dimensions noted. FIG. 3 is a perspective view of the improved cubicle curtain 100 of FIG. 1 as deployed from an overhead track in a typical hospital room. As shown, the cubicle curtain 100 is suspended around a patient bed by a suitable support means. An exemplary support means is a track attached to the ceiling and corresponding sliders that support an upper edge of the cubicle curtain 100. The following dimensions, while exemplary, are noted in FIG. 2:

1. Maximum print size is 52"×76", therefore the maximum width of each panel can be no wider than 52" including the border (Dimension "J").
2. Measurement "A" is 76".
3. Measurement "B" is 104" before any joining.
4. Measurement "C" is 48".
5. Measurement "D" is 78".
6. Measurement "E" is 39".
7. Measurement "F" is 7".
8. Measurement "G" is 13".
9. Measurement "H" is 21".
10. Measurement "I" is ½" seam allowance.
11. Measurement "J" can be no wider than 52" (due to processing constraints on the currently available printing equipment).

The following terms, used below, are defined as follows:

MURAL: Main image on curtain measuring 56×92 inches, created by joining two 7'7×52 inch panels, left panel MURAL A, and right panel, MURAL B.

BACKGROUND: Portion of MURAL extracted and made to repeat every 77×52 inches, printed at 0.25% opacity of the MURAL.

PANEL: Single piece of cloth measuring 77×52 inches,

The process used to create the cubicle curtains 100 with a framed calming image 120 according to the first embodiment is as follows:

1) 3.25×3 inch Polaroid SX70 image is exposed

2) Polaroid is cured for a minimum of two hours, to a maximum of 6 hours.

3) Polaroid is, heated and burnished under medium heat in order to spread the dies in the Polaroid and create an impressionistic look.

4) Polaroid is scanned to 77×77 inches at 72 dpi. Three combinations of size and dpi were used before determining the optimum resolution to print PANELS.

5) Multiple Polaroid images are digitally combined to form-final MURAL composition.

6) MURAL is further painted digitally and color corrected.

7) BACKGROUND digital file is extracted from MURAL to form a repeating PANEL 77×52 inches. The repeat is created digitally by cloning the first six itches of the left vertical edge of the BACKGROUND. The cloned area is placed on the right edge of the BACKGROUND. It is then painted digitally to form a smooth transition across the edge, creating a continuous repeating pattern.

8) 12×12 inch areas of MURAL are digitally sampled and printed digitally with sublimation dyes on digital sublimation paper for color proofing.

9) MURAL samples are transferred to cloth at 410 degrees for 35 seconds to proof color.

10) MURAL color is digitally adjusted; steps 8 and 9 are repeated until the color is correct.

11) 12×12 inch area of BACKGROUND is digitally sampled and printed digitally with sublimation dyes on digital sublimation paper for color proofing.

12) BACKGROUND paper sample is transferred to cloth at 410 degrees for 35 seconds to proof color, 13) BACKGROUND color is digitally adjusted; steps 11 and 12 are repeated until the color is correct.

14) MURAL PANEL is digitally prepared for printing: Sized to 56×92 inches then cut in half to form the MURAL A (left) PANEL, and, B (right) PANEL.

15) MURAL A is digitally inserted into BACKGROUND with a six-inch border on the top and side of the MURAL.

16) A half-inch border is digitally cloned and added to the vertical edges to create the seam allowance for joining PANELS. Cloning a half-inch from the left edge forms the left hand seam allowance. Cloning a half-inch from the right edge forms the right hand seam allowance.

17) Inserted MURAL A section and BACKGROUND digital file is ink jet printed with sublimation dyes onto 77×52 inch digital sublimation paper.

18) MURAL A and BACKGROUND digital sublimation paper is transferred* onto 77×52 inch cloth at 405 degrees and at 3 yards per minute to create the left PANEL.

19) MURAL B is digitally inserted into BACKGROUND with a six-inch border on the top and side of MURAL.

20) A half-inch border is digitally cloned and added to the vertical edges to create the seam allowance for joining PANELS. Cloning a half-inch from the left edge forms the left hand seam allowance. Cloning a half-inch from the right edge forms the right hand seam allowance.

21) Alignment marks are digitally added every six inches to the cloned area to allow accurate alignment of PANELS.

22) Inserted MURAL B section and BACKGROUND digital file is ink jet printed with sublimation dyes onto 77×52 inch digital sublimation paper.

23) MURAL Band BACKGROUND digital sublimation paper is transferred* onto 77×52 inch cloth at 405 degrees and at 3 yards per minute to create the right PANEL.

24) BACKGROUND digital file is ink jet printed with sublimation dyes onto 77×52 inch digital sublimation paper.

25) BACKGROUND digital sublimation paper is transferred* onto 77×52 inch cloth at 405 degrees/3 yards per minute to create the BACKGROUND PANEL.

26) PANELS are assembled and sewn to produce finished curtain. The number of PANELS assembled determines the final size of the finished curtain. A two PANEL MURAL will measure 104 inches in length. A four PANEL curtain will consist of two MURAL PANELS, plus two additional BACKGROUND PANELS, measuring a 208 inches in length.

27) The full size digitally printed, assembled curtain is examined for composition, color, and design flaws.

28) Flaws that are found are corrected on the digital files for MURAL A+BACKGROUND, MURAL B+BACKGROUND, and BACKGROUND. The files are then are color separated to produce plates for four color offset sublimation printing of MURAL A+BACKGROUND, MURAL B+BACKGROUND, and BACKGROUND.

29) MURAL A+BACKGROUND is printed using four color-offset sublimation printing onto 77×52 inch sublimation paper.

30) MURAL B+BACKGROUND is printed using four color-offset sublimation printing onto 77×52 inch sublimation paper.

31) BACKGROUND is printed using four color-offset sublimation printing onto 77×52 inch sublimation paper.

32) MURAL A+BACKGROUND and MURAL B+BACKGROUND are alternately transferred to more consistently render color across both panels. The sublimation paper is transferred at 400 degrees/5 yards per minute to produce finished PANELS.

33) BACKGROUND is transferred separately from step 30. The sublimation paper is transferred at 400 degrees/5 yards per minute to produce finished PANELS.

As to the transfer* noted above, the 77×52 inch digitally printed sublimation paper produced inaccurate color and streaking when transferred at convention temperature and time settings of 400 degrees and 5 yards per minute. Five different combinations of transfer temperature and time were tried before determining the exact temperature/time setting needed to accurately transfer color and resolve streaking problem with 77×52 inch cloth.

SECOND EMBODIMENT

Figure 4:
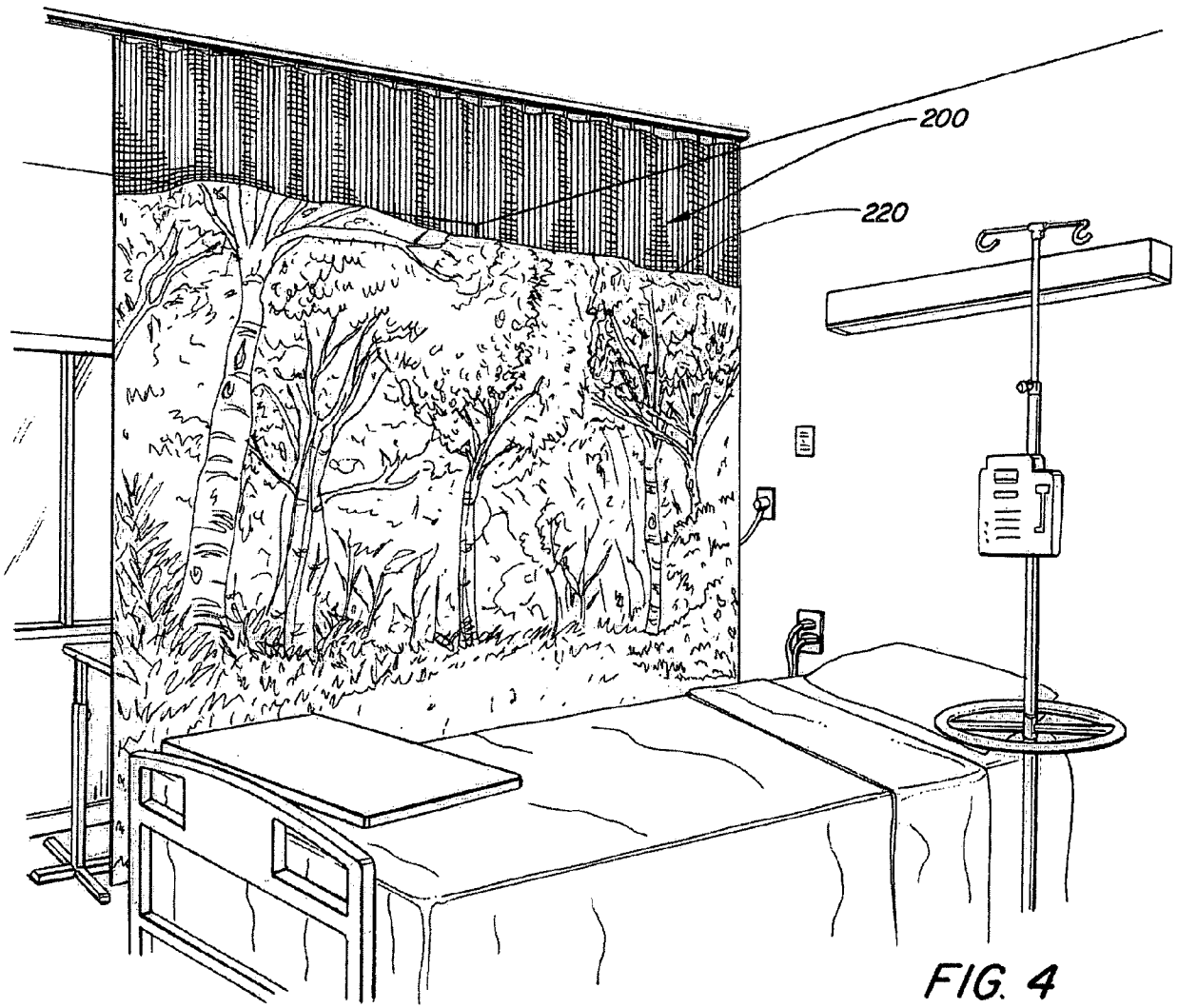
FIG. 4 is a perspective view of an improved cubicle curtain 200 according to a second preferred embodiment of this invention wherein the calming image 220 runs edge-to-edge in order to provide a more effective "you are there" impression to the recovering patient.

FIG. 4 is a perspective view of an improved cubicle curtain 200 according to a second preferred embodiment of this invention wherein the calming image 220 runs edge-to-edge in order to provide a more effective "you are there" impression to the recovering patient. In this particular embodiment, the goal was to create a sharper, more photographic image 220, as opposed to the impressionistic image 120 associated with the Polaroid process used in the first embodiment. The number and type of calming images that may be used is infinite. The image suggested by FIG. 4 corresponds to a photograph called "Tranquility", an image that features a calming garden full of tulips.

Figure 5:
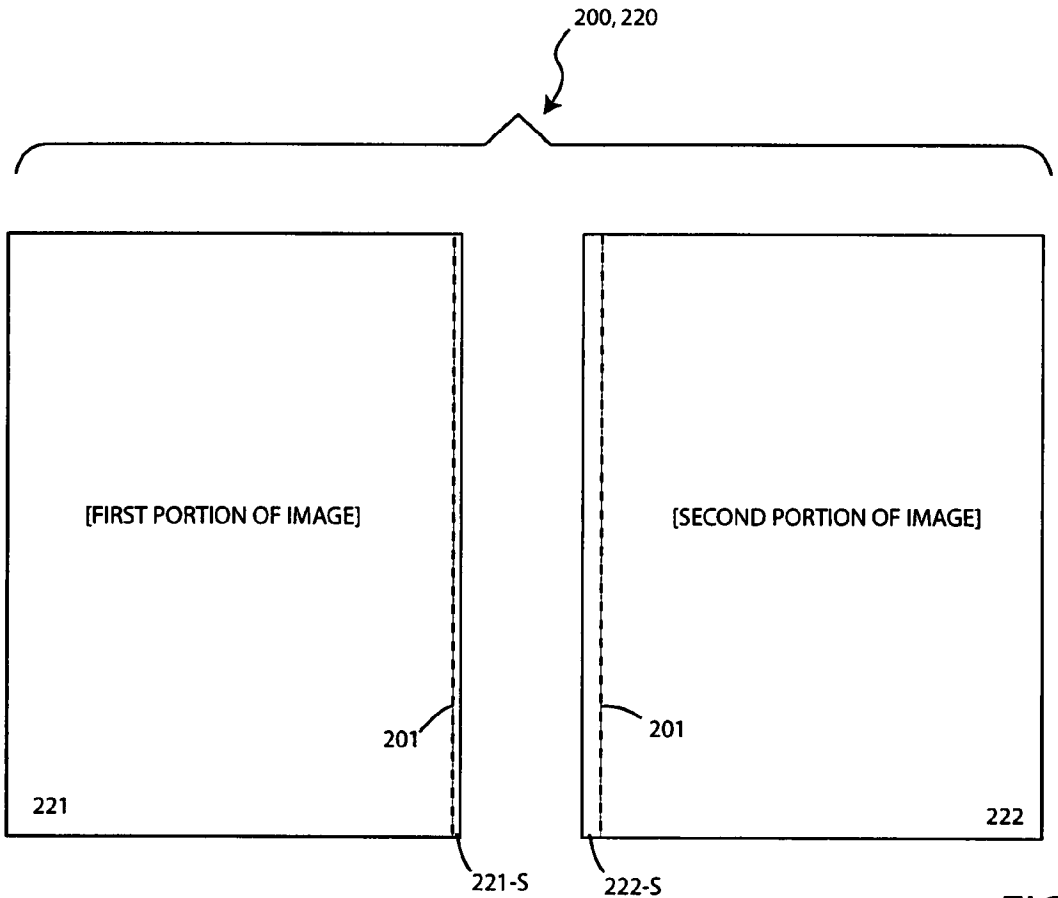
FIG. 5 is a simplified side view of the improved cubicle curtain 200 of FIG. 5 prior to the joining of first and second panels of cloth that each contain corresponding portions of the image.

As further shown in FIG. 5, the preferred cubicle curtain 200 is formed from a first substantially rectangular panel of cloth 221 having a first portion of the calming image (implied) and a second substantially rectangular panel of cloth 222 having a second portion of the calming image (also implied). The two panels are stitched together at a seam 201, with the image portions in registration so that the seam 201 is not distracting. The cubicle curtain 200, of course, may contain more than two panels. At present, it is anticipated that two panels would be the smallest and five panels would be the largest.

Figure 6:
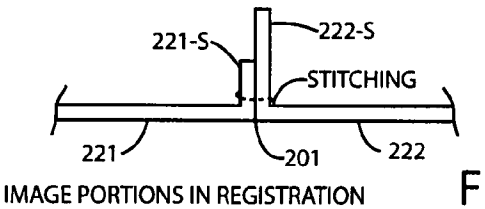
FIG. 6 is an edge view of the cubicle curtain 200 of FIG. 5 when viewed at a seam 201 between the two panels

The first and second panels 221, 222 are stitched together using well-known seaming techniques. For purposes of providing registration between the first and second portions of the image, however, each portion contains first and second seam strips 221-S, 222-S. The seam strips 221-S, 222-S contain overlapping portions of the image from the adjacent image portion so that some very minor registration error is not too obvious. This overlap is accomplished by editing the digital files used to create the first and second image portions transferred to the first and second panels 221, 222. As best shown in FIG. 6, the width of the seam strips 221-S, 222-S may vary to accommodate the particular sewing equipment used. Of course, it is possible to use other known seaming techniques.

In the second preferred embodiment, conventional large format film is used instead of Polaroid. The goal here is to create an overall image that is photographically sharp, rather than impressionistic. It was discovered that large format film contained sufficient resolution for scanning at sufficiently high resolution to obtain the desired effect.

The currently preferred method for producing a hospital bed cubicle curtain as shown in FIG. 4 is as follows:

Expose an image using a large format camera, anywhere from 6×7 to 6×17. The result is a large format transparency.

Scan the resulting transparency on a high quality drum scanner to create a large digital image file at 200 dpi at half size. (600 MB files).

Create a prototype or "digital facsimile" to make sure that the image works at full size. At present, the prototype is created with a dye sublimation printer that has 54" wide rollers. The presently preferred printer is a 3M printer that was modified for this type of printing. It is available at Beta Management having an address at 4385 East Lowell St., Suite A, Ontario, Calif. 91761.

The Beta Management printer uses the digital image file (e.g. a Photoshop PSD file, or portions thereof) to form a dot-by-dot image onto heat transfer paper, the image thereafter being transferred to suitable cloth by laying the paper against the cloth roll and putting it through a heat roller at 400 degrees/5 yards per minute. The foregoing rate is adequate for the prototype, but the inventor found that for mass production purposes (discussed below), the standard temperatures and travel rates were not ideal. In particular, it was discovered that due to the full width of the transfer process taking place, it was necessary to slow down the travel rate in order to maintain an adequate transfer temperature and avoid streaking.

In practice, Beta Management manually sections the digital Photoshop file to create the first and second portions of the image suggested by FIG. 5. It is important to account for the necessary width of the facing seam strips 221-S, 222-S. Initially, when working with a first sewing facility, a ½" seam allowance was needed for both seam strips 221-S, 222-S. At present, with a different sewing facility, one seam strip 221-S needs to be ¼" in width and the other seam strip 222-S needs to be ½" in width. For ¼" on the left and ½" on the right, and with a 200 dpi Photoshop file, the image is chopped into two parts with 50 extra dots added to the left from the right side of the intended seam 201 and with 100 extra dots added to the right portion from the left side of the desired seam 201.

While Beta Management provides the heat transfer paper, the inventor has chosen the cloth. The preferred cloth is a triple woven cloth fabric that essentially has three layers of cloth. The triple woven cloth is preferred because the middle layer absorbs the dye that would otherwise be visible as splotches on the other side of the curtain 200.

In general, the side of the curtain that is opposite to the patient should be neutral such in order to make a room with multiple such curtains 200 visually overwhelming. At present, the opposite side is left monotonic in color (beige), or a muted pattern of suitable nature is applied.

At present, a four color lithographic process is used for mass production purposes. As with the prototype, a digital file is supplied, but only at 80 dpi rather than at 200 dpi. The lithography service operates presses that have been modified to lithographically print dye sublimation inks onto heat transfer paper with a four color separation process using four different separation screens. There lithographic press, like the prototyper's digital equipment, is also 54" wide.

For registration purposes, hash marks are added on the lithographic separation screens so that small marks are included every 6 inches near the intended seam 201. These marks help the seamstress keep the panels in vertical registration.

THIRD EMBODIMENT

Figure 7:
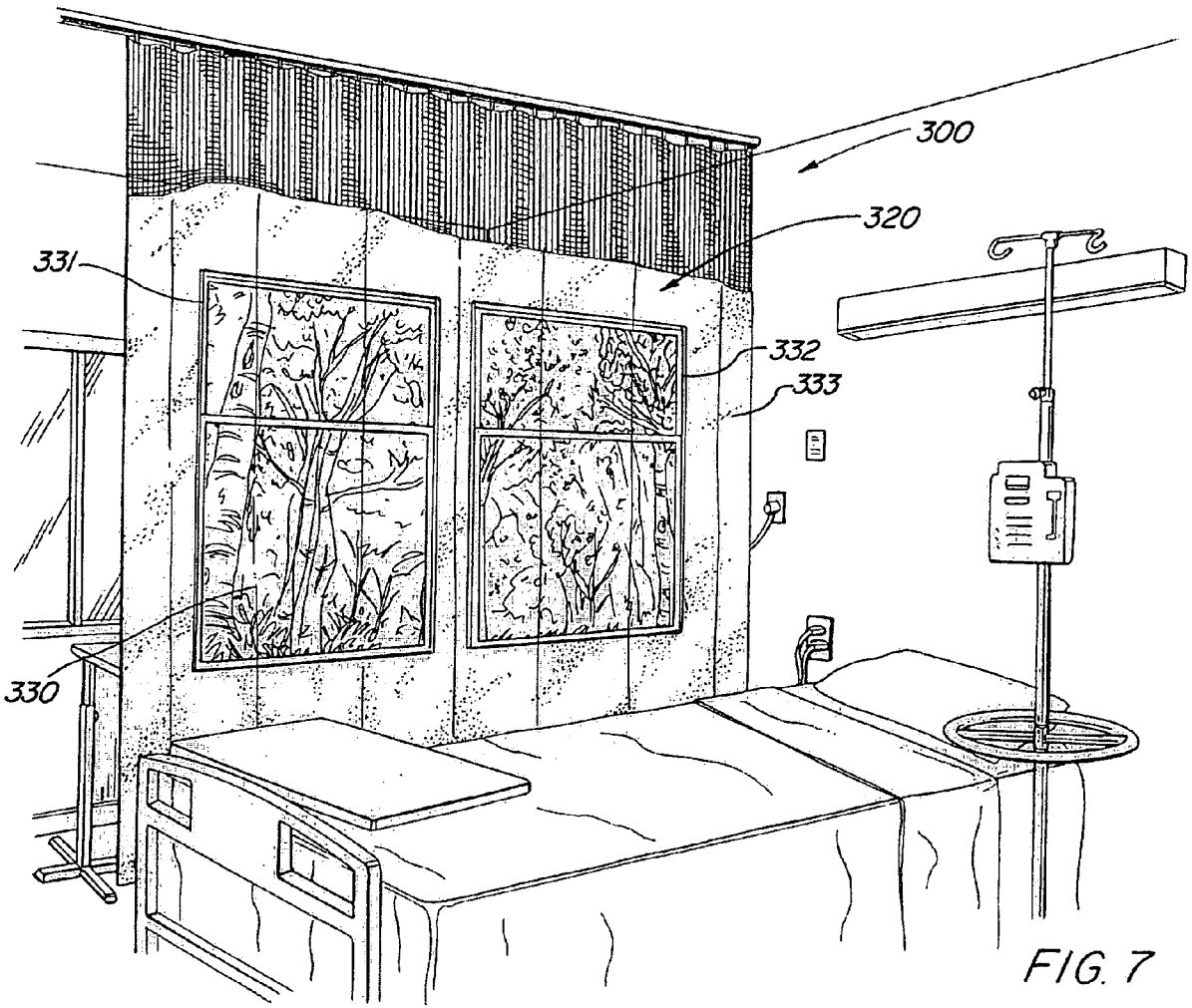
FIG. 7 is a perspective view of an improved cubicle curtain 300 according to a third preferred embodiment of this invention wherein the calming image 320 depicts an outdoor scene 330 as viewed through a window 331.

FIG. 7 shows a third embodiment wherein the curtain 300 contains a calming image 320 that depicts an image of a wall surface 333 containing a window 331 through which an outdoor scene 330 is visible. The wall surface 333 can be a blank expanse or, preferably, an image of a textured surface with a random pattern such as a textured plaster wall to make the image of the wall surface look more realistic and make the seam less evident. The calming effect is expected to be comparable to the prior described embodiments, but perhaps moreso since the window-containing calming image 320 is mentally consistent with the interior location of the curtain 300.

FIG. 7, in more detail, is a perspective view of an improved cubicle curtain 300 according to a third preferred embodiment of this invention witherin the calming image 320 depicts an outdoor scene 330 as viewed through a window 331. As shown, the calming image 320 may contain not only one, but rather two windows 331, 332, with the area between the windows being a convenient place to seam together two panels if two panels are used to create the curtain 300.

FOURTH EMBODIMENT

Figure 8:
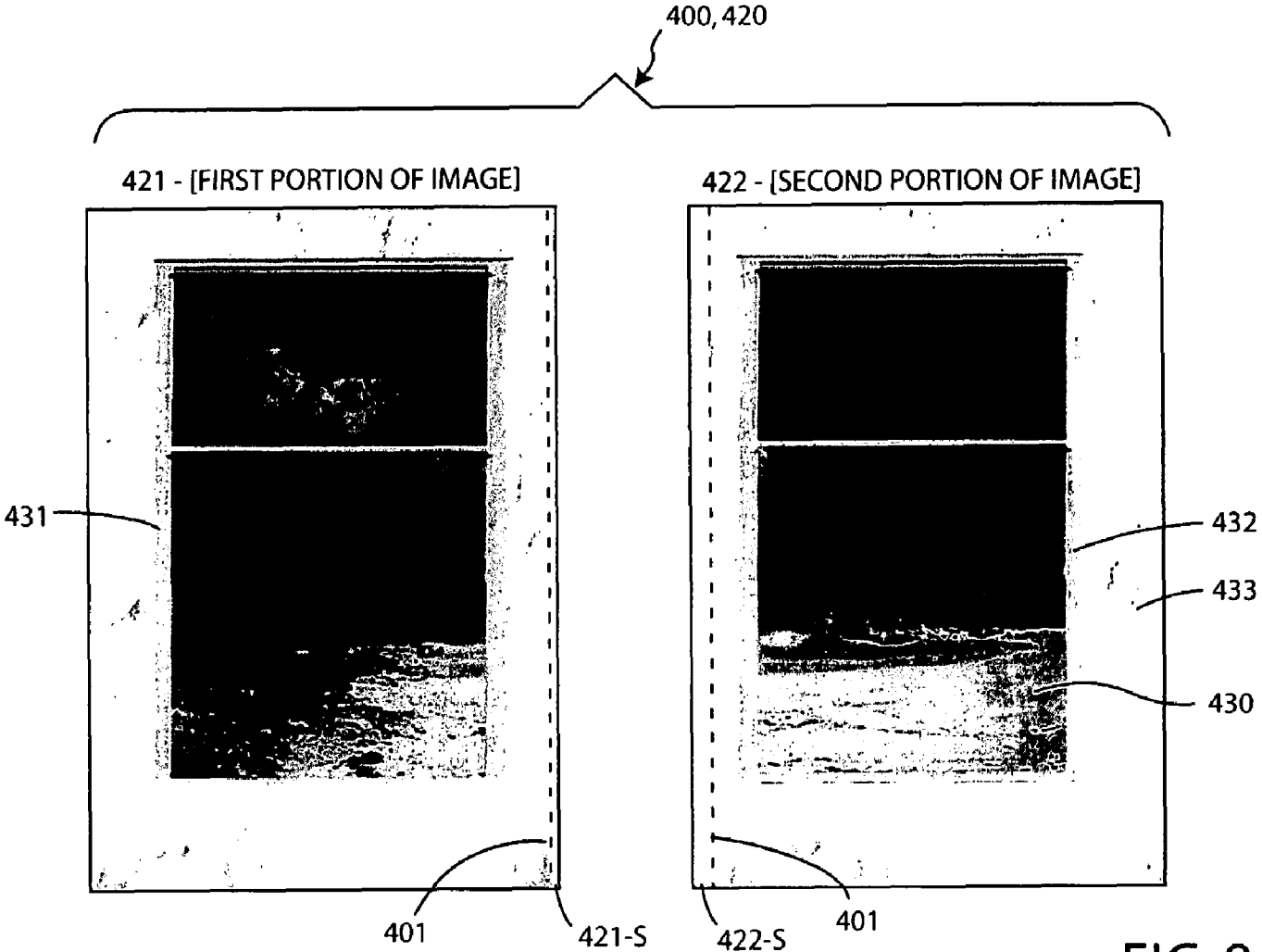
FIG. 8 is a simplified side view of a cubicle curtain 400 (similar to cubicle curtain 300 of FIG. 7) with a calming image 420 that depicts an outdoor scene 430 (here an ocean shore) as viewed through a pair of windows 431, 432, the image 420 being provided on first substantially rectangular panel of cloth 421 having a first portion of the calming image 420 and a second substantially rectangular panel of cloth 422 having a second portion of the calming image.
Figure 9:
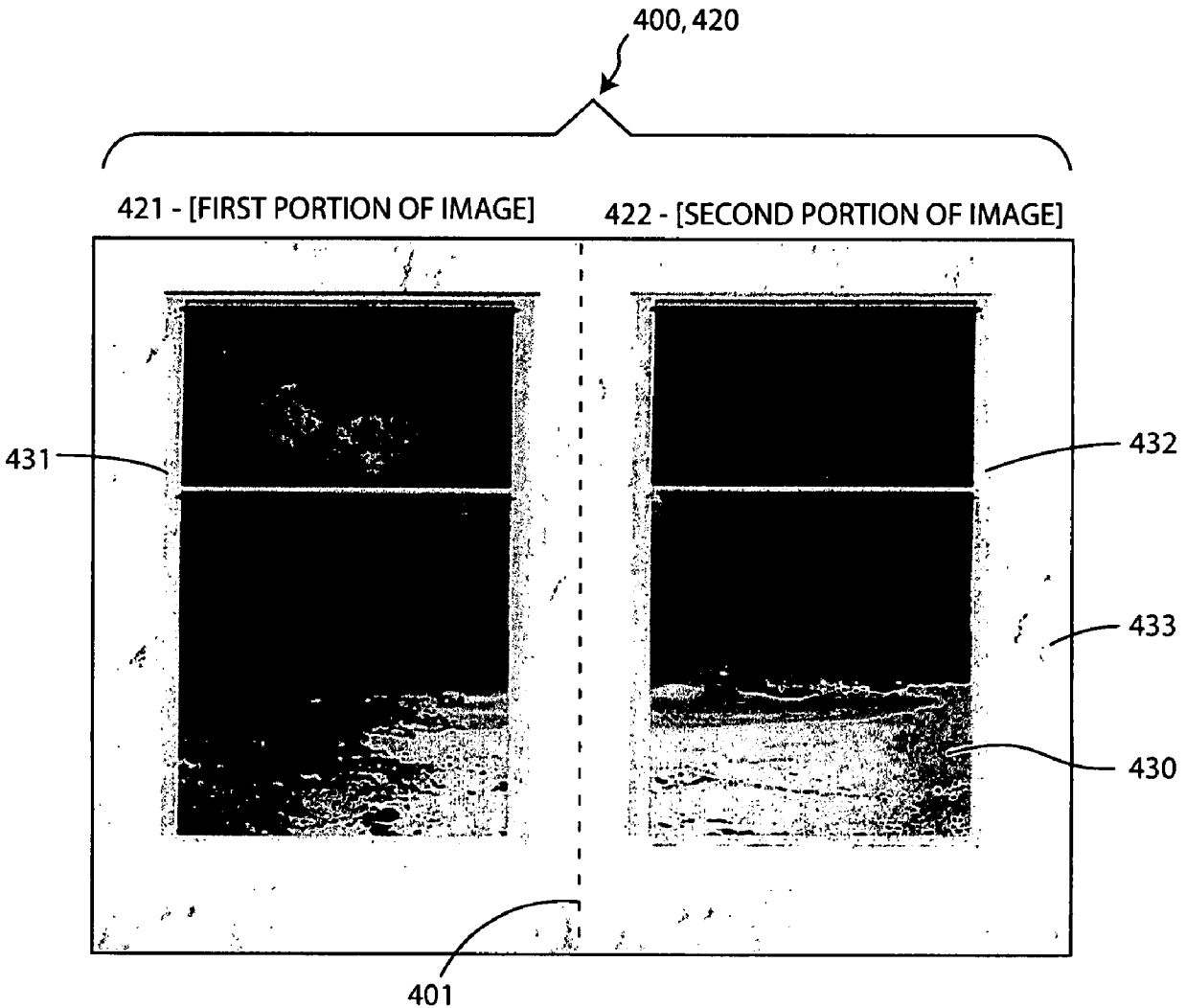
FIG. 9 is a simplified side view of the cubicle curtain 400 of FIG. 8 after the panels have been stitched together at a seam 401.

FIGS. 8-9 show a fourth embodiment where two panels are, in fact, used to create an overall curtain 400 having a calming image 420 formed from portions that each contain an image of an outdoor scene as viewed through a window. Preferably, as shown, the calming image depicts a single, contiguous outdoor scene viewed through side-by-side windows when the two portions are positioned side-by-side. It is believed that the perception of looking through two separate windows may be physchologically superior because because it gives an enhanced perception of distance or perspective. In other words, such an image gives the perception of lying peacefully in bed in a home next to the woods, as opposed to literally lying in the woods.

FIG. 8, in more detail, is a simplified side view of a curtain 400 (similar to curtain 300 of FIG. 7) with a calming image 420 that depicts an outdoor scene 430 (here an ocean shore) as viewed through a pair of windows 431, 432, the image 420 being provided on first substantially rectangular panel of cloth 421 having a first portion of the calming image 420 and a second substantially rectangular panel of cloth 422 having a second portion of the patient image. As shown, the where the image contains two or more windows, the seam may be conveniently located within the image of the wall surface between adjacent windows. The wall surface image, moreover, may be a blank expanse or, as noted above, an image of a textured or otherwise non-uniform wall surface in order to visually minimize the seam.

FIG. 9 is a simplified side view of the cubicle curtain 400 of FIG. 8 after the panels have been stitched together at a seam 401 located between the adjacent window images 431, 432.

The above description is directed to the presently preferred embodiments of the subject invention. It should be understood that various modification are possible without departing from the spirit and scope of the herein claimed invention. The preferred embodiments, therefore, should not be used to limit the scope of the invention that is set forth in the following claims.

I claim:

1. A healing enhancement apparatus comprising:

a hospital bed cubicle curtain; and a patient calming nature image printed on the hospital bed cubicle curtain wherein the patient calming nature image is an image of a wall surface having a window through which an outdoor scene is visible, wherein the hospital bed cubicle curtain further comprises:

a first substantially rectangular panel of cloth having a first portion of the patient calming nature image; and a second substantially rectangular panel of cloth having a second non-identical portion of the calming image that is different from the first portion of the patient calming nature image on the first substantially rectangular panel; and the first and second panels and corresponding portions of the patient calming nature image are joined to one another at a seam;

wherein the first substantially rectangular panel of cloth and first portion of the patient calming nature image includes a first seam strip formed from an overlapping portion of the second non-identical portion of the patient calming nature image; and wherein the second substantially rectangular panel of cloth and second non-identical portion of the calming image includes a second seam strip formed from an overlapping portion of the first portion of the patient calming nature image;

the first and second seam strips abutted against one another and extending from the patient calming nature image at the seam with an exposed portion of the first and second portions of the patient calming nature image in registration.

2. The healing enhancement apparatus of claim 1 wherein the patient calming nature image is an image of a wall surface having first and second windows and wherein the first portion of the patient calming nature image on the first substantially rectangular panel of cloth contains the first window, wherein the second portion of the patient calming nature image on the second substantially rectangular panel of cloth contains the second window, and wherein the seam is between the windows.

3. The healing enhancement apparatus of claim 2 wherein the seam is provided within the image of a textured wall surface located between the windows.

4. The healing enhancement apparatus of claim 1 wherein the patient calming nature image comprises a photograph.

5. The healing enhancement apparatus of claim 1 wherein the patient calming nature image comprises a digital scan of an image.

6. The healing enhancement apparatus of claim 1 wherein the first and second portions of the patient calming nature image are printed onto first and second papers using a dye sublimation process and then transferred from the first and second papers onto the first and second panels of cloth using heat and pressure.

7. The healing enhancement apparatus of claim 6 wherein the cloth is triple woven cloth fabric such that dye transferred to the cloth does not bleed through to the other side.

8. The healing enhancement apparatus of claim 1 wherein the first and second portions of the patient calming nature image are printed directly to the first and second panels of cloth.

9. The healing enhancement apparatus of claim 1 wherein a patient-facing side of the curtain contains the calming image.

10. The healing enhancement apparatus of claim 9 wherein an opposite side of the curtain does not contain an image.

11. The healing enhancement apparatus of claim 9 wherein an opposite side, of the hospital bed cubicle curtain contains one of a solid and muted pattern.

* * * * *